United States Patent [19]

Taguchi

[11] Patent Number: 4,937,868

[45] Date of Patent: Jun. 26, 1990

[54] SPEECH ANALYSIS-SYNTHESIS SYSTEM USING SINUSOIDAL WAVES

[75] Inventor: Tetsu Taguchi, Tokyo, Japan

[73] Assignee: NEC Corporation, Tokyo, Japan

[21] Appl. No.: 59,910

[22] Filed: Jun. 9, 1987

[30] Foreign Application Priority Data

Jun. 9, 1986 [JP] Japan ..... 61-134571

[51] Int. Cl.[5] ..... G10L 7/02

[52] U.S. Cl. ..... 381/38

[58] Field of Search ..... 381/29-32, 381/36-41, 51-53; 364/513.5

[56] References Cited

U.S. PATENT DOCUMENTS

| | | | |
|---|---|---|---|
| 3,102,928 | 9/1963 | Schroeder | 381/51 |
| 3,109,070 | 10/1963 | David et al. | 381/51 |
| 3,124,654 | 3/1964 | Raisbeck | 381/37 |
| 3,369,077 | 2/1968 | French et al. | 381/38 |
| 3,982,070 | 9/1976 | Flanagan | 381/51 |
| 4,403,118 | 9/1983 | Zollner et al. | 381/68.2 |
| 4,815,135 | 3/1989 | Taguchi | 381/37 |

*Primary Examiner*—Gary V. Harkcom
*Assistant Examiner*—John A. Merecki
*Attorney, Agent, or Firm*—Sughrue, Mion, Zinn, Macpeak & Seas

[57] ABSTRACT

From a speech signal, spectrum information as a plurality of line spectrum data, pitch position data and amplitude data are extracted. Each of the sinusoidal wave signals of different frequencies is allotted to the predetermined line spectrum data. The frequency of the sinusoidal wave signal is changed with the pitch position being the boundary. The plurality of sinusoidal wave signals are added and the added result is modulated by the amplitude data to transmit the modulated signal as the transmission data. The line spectrum data, the pitch position data and amplitude data are extracted from the modulated signal. The replica of the speech is produced on the basis of these extracted data.

23 Claims, 14 Drawing Sheets

| OUTPUT | I | II | III | IV |
|---|---|---|---|---|
| f1 | ω1' | ω2' | ω1' | ω2' |
| f2 | ω2' | ω1' | ω2' | ω1' |
| f3 | ω3' | ω4' | ω3' | ω4' |
| f4 | ω4' | ω3' | ω4' | ω3' |
| f5 | ω5' | ω6' | ω5' | ω6' |
| f6 | ω6' | ω5' | ω6' | ω5' |
| f7 | ω7' | ω8' | ω7' | ω8' |
| f8 | ω8' | ω7' | ω8' | ω7' |
| f9 | ω9' | ω10' | ω9' | ω10' |
| f10 | ω10' | ω9' | ω10' | ω9' |

AMP
I
II
III
IV
TIME
1
0

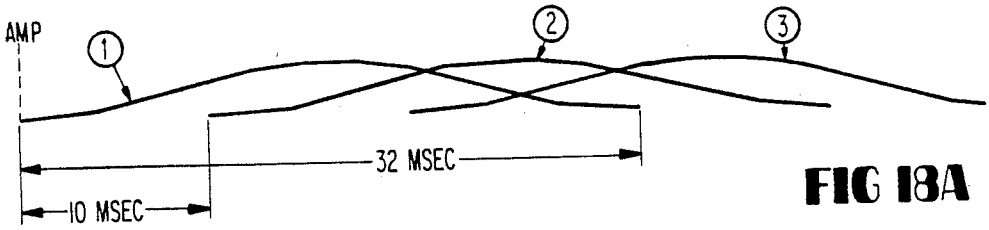
FIG 18A
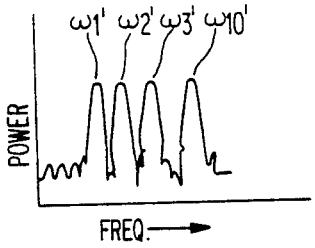
FIG 18B
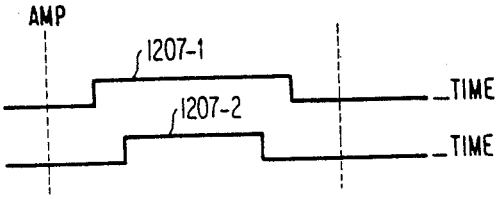
FIG 18C
FIG 18D
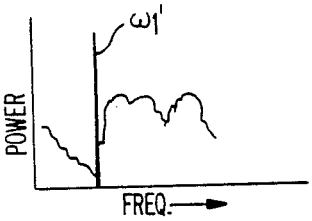
FIG 18E
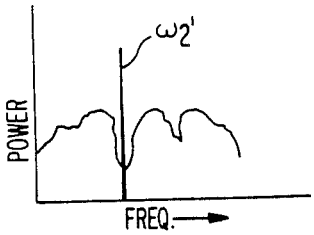
FIG 18F
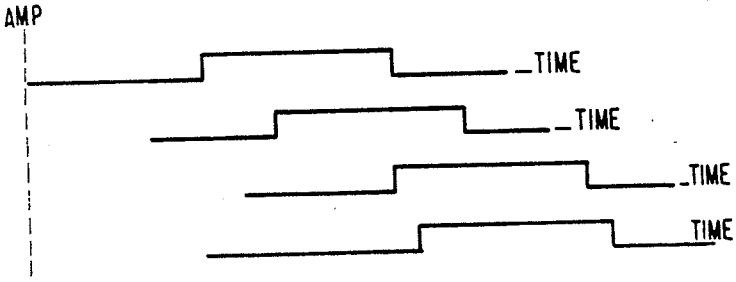
FIG 18G
FIG 18H
FIG 18I
FIG 18J

AMP

TIME

TIME

TIME

TIME

TIME
0

TIME
0

TIME
0
PO
PO
PO
PO
PO
PO

TIME

SPEECH ANALYSIS-SYNTHESIS SYSTEM USING SINUSOIDAL WAVES

BACKGROUND OF THE INVENTION

This invention relates to a speech processing system and more particularly to an improvement in synthesized speech quality of a speech analysis-synthesis system which transmits speech parameters containing spectrum envelop information expressed by a plurality of line spectra in the analog form.

There has been widely employed a speech analysis-synthesis system which transmits speech parameters containing spectrum envelop information expressed by a plurality of line spectra such as well-known LSP (Line Spectrum Pairs) or by CSM (Composite Sinusoidal Model) in the analog form. In this system, pitch information is transmitted as one of the parameter data such as a pitch period for band compression.

In accordance with this conventional analysis-synthesis system employing the parameter data transmission, a speech exciting waveform is not transmitted and hence reproduction of pitch excitation time of the exciting waveform cannot be obtained. Accordingly, there is an inevitable limit to the quality of synthesized speech.

SUMMARY OF THE INVENTION

It is an object of the present invention to provide a speech processing system which drastically improves the synthesized speech quality in a narrow transmission band.

It is another object of the present invention to provide a speech analysis-synthesis system which reduces a transmission band.

According to the present invention, spectrum information as a plurality of line spectrum data, pitch position data and amplitude data are extracted from a speech signal. Each of the sinusoidal wave signals of different frequencies is allotted to the predetermined line spectrum data. The frequency of the sinusoidal wave signal is changed with the pitch position. The plurality of sinusoidal wave signals are summed up and the summed result is modulated by the amplitude data. The modulated signal is transmitted as the transmission data to a synthesis side where the line spectrum data, the pitch position data and amplitude data are extracted from the modulated signal. The replica of the speech is produced on the basis of these extracted data.

Other objects and features of the present invention will be clarified from the following explanation with reference to the drawings.

BRIEF DESCRIPTION OF THE DRAWINGS

FIGS. 18A through 18J and 19A through 19D are explanatory views useful for explaining the operation on the synthesis side shown in FIG. 17;

DESCRIPTION OF THE PREFERRED EMBODIMENTS

Figure 1:
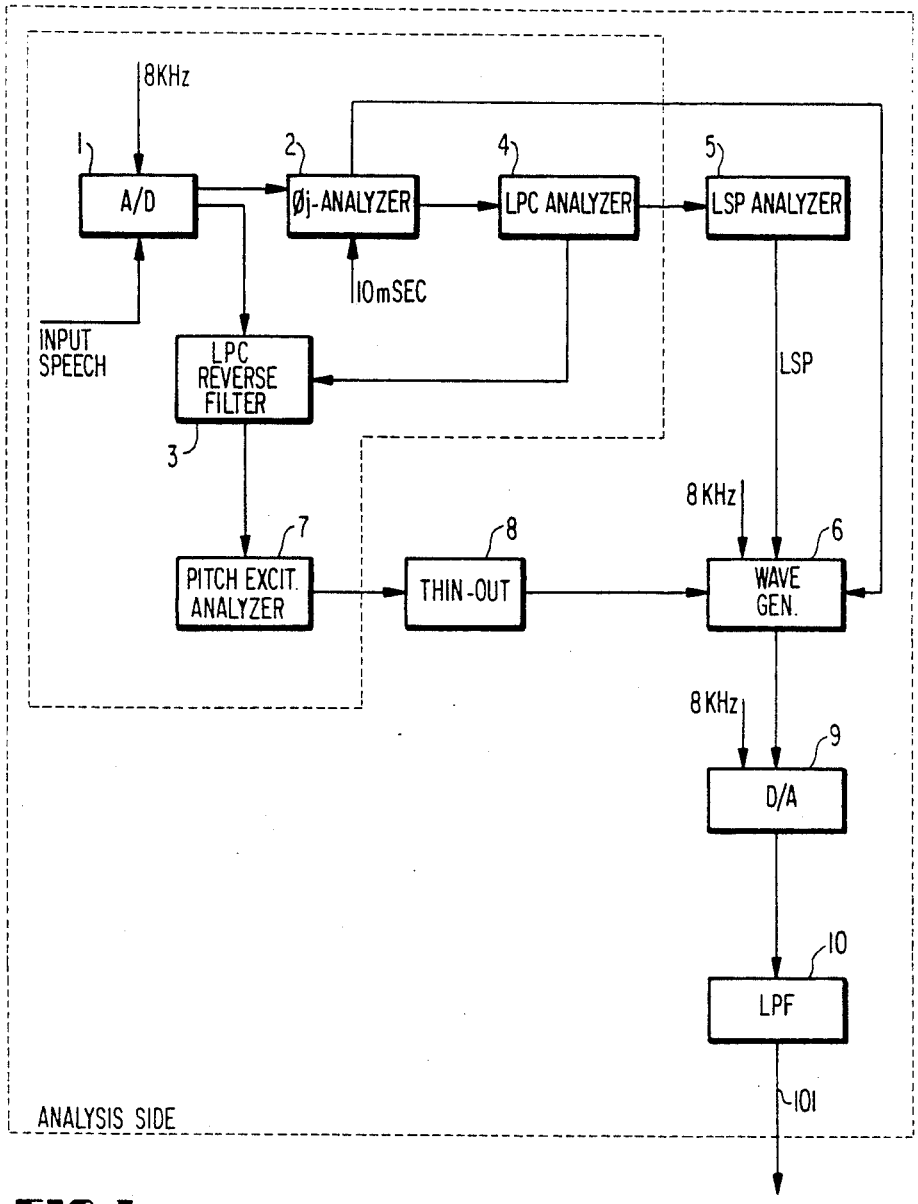
FIG. 1 is a block diagram of one embodiment of a speech analysis-synthesis system on its analysis side in accordance with the present invention.

The analysis side of the speech analysis-synthesis system shown in FIG. 1 comprises an A/D convertor 1, an autocorrelation analyzer 2, an LPC (Linear Prediction Coding) inverse filter 3, an LPC analyzer 4, an LSP analyzer 5, a waveform generator 6, a pitch excitation time analyzer 7, a pitch excitation time thinning-out unit 8, a D/A convertor 9 and LPF (Low Pass Filter) 10.

Figure 2:
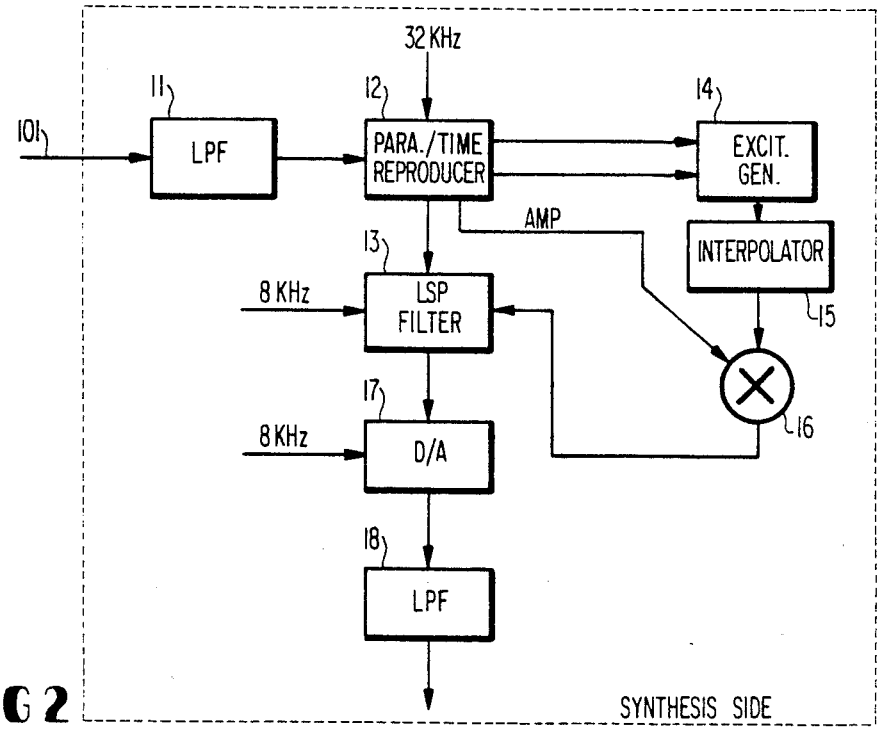
FIG. 2 is a block diagram of one embodiment of the speech analysis-synthesis system on its synthesis side of the present invention.

The synthesis side shown in FIG. 2 consists of an LPF 11, a parameter-time reproducer 12, an LSP filter 13, a speech exciting source generator 14, an interpolator 15, a multiplier 16, a D/A convertor 17 and an LPF 18, In FIG. 1, an input speech is supplied to the A/D convertor 1 and filtered by a built-in lowpass filter having a high frequency 3.4 KHz, sampled by an 8 KHz sampling frequency and digitized with a 12-bit quantization step. The digitized speech signals of 30 msec, 240 samples (one block) is temporarily stored in an internal memory, then subjected to a window processing for segmenting the block by multiplying it by a predetermined window function such as a Humming function for every analysis frame of 10 msec and supplied to the autocorrelation analyzer 2.

The autocorrelation analyzer 2 calculates the autocorrelation function $\phi_j (j=0, 1, \ldots, 10)$ expressed by the formula (1) below from the digitized speech signal $x_i$ $(i=0, 1, \ldots, 239)$ for each frame supplied from the A/D convertor 1.

$$\phi_j = \sum_{i=0}^{239-j} x_i \cdot x_{i+j} \quad (1)$$

The autocorrelation analyzer 2 supplies the calculated $\phi_0$ value as electric power data expressing the speech electric power for a short period to the waveform generator 6. Furthermore, the autocorrelation analyzer 2 normalizes $\phi_j (j=1, 2, \ldots, 10)$ in accordance with the following formula (2) and outputs a normalized autocorrelation function $\rho_j (j=1, 2, \ldots, 10)$ to the LPC analyzer 4.

$$\rho_j = \frac{\phi_j}{\phi_0} \quad (2)$$

The A/D convertor 1 outputs those digitized speech signals which are not subjected to window processing, that is, $S_i (i=\ldots -2, -1, 0, 1, 2 \ldots)$ to the LPC inverse filter 3.

The LPC inverse filter 3 extracts the residual waveform $e_i (i=\ldots, -2, -1, 0, 1, 2, \ldots)$ from the speech signals supplied thereto by its filter characteristics and supplies it to the pitch excitation time analyzer 7. In this case, as the filter coefficients of the LPC inverse filter 3, 10-order $\alpha$ parameters $\alpha_1, \alpha_2, \ldots, \alpha_{10}$ provided from the LPC analyzer 4 for each analysis frame are used.

The LPC analyzer 4 responsive to the 10-order autocorrelation coefficients $\rho_1, \rho_2, \ldots, \rho_{10}$ supplied thereto from the autocorrelation analyzer 2, extracts the $\alpha$ parameters $\alpha_1, \alpha_2, \ldots, \alpha_{10}$ as the 10-order LPC coefficients by known LPC analysis technique and supplies them to the LPC inverse filter 3 for each analysis frame.

Figure 3:
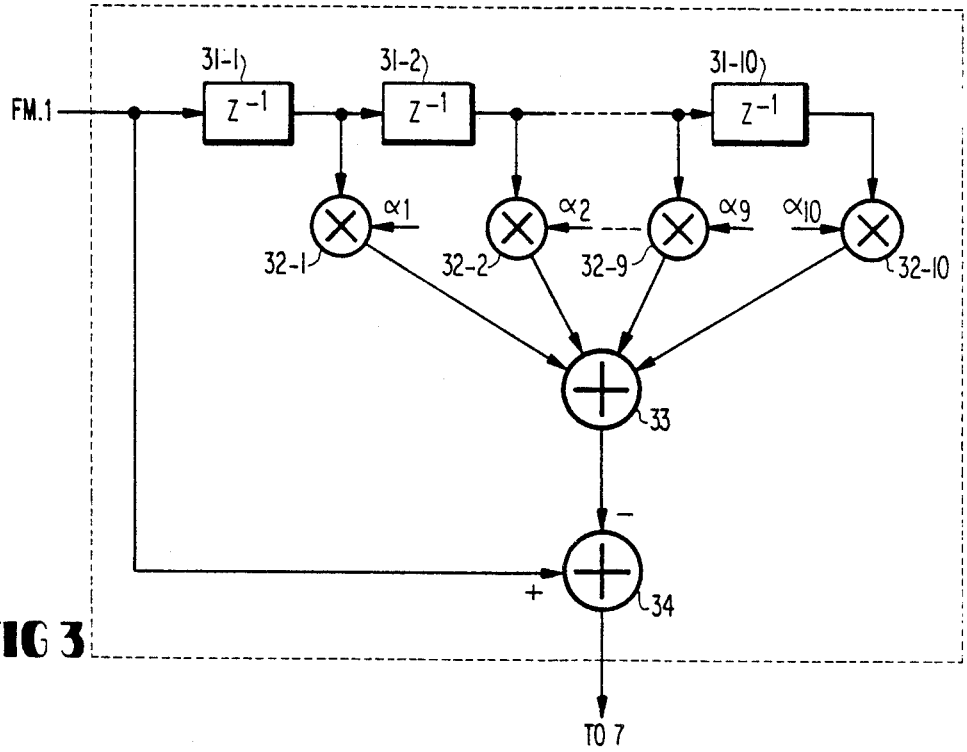
FIG. 3 is a block diagram showing in detail an LPC reverse filter 3 shown in FIG. 1.

The LPC inverse filter shown in FIG. 3 is a digital filter which consists of unit delay elements 31-1 to 31-10, multipliers 32-1 to 32-10 and adders 33 and 34. This filter 3 has inverse time domain characteristics to the spectrum envelop characteristics determined by the LPC coefficient from the LPC analyzer 4, with the weighting coefficient of the $\alpha$ parameters $\alpha_1, \alpha_2, \ldots, \alpha_{10}$ for each analysis frame.

Now, it is known that the speech waveform depends upon the frequency characteristics of a glottice and the vocal cord vibration waveform of a speaker. It is also known that the spectrum envelop characteristics determined by the LPC coefficient are analogous to the frequency characteristics of the glottice described above. Therefore, in the speech signal x supplied from the A/D convertor 1, the frequency characteristics of the glottice are eliminated by the LPC inverse filter. In other words, the LPC inverse filter 3 determines the waveform analogous to the vocal cord vibration waveform (hereinafter called the "residual waveform") $e_i$ from the speech signal x and supplies it to the pitch excitation time analyzer 7. Needless to say, the residual waveform $e_i$ has periodicity corresponding to the vocal cord vibration period, that is, the pitch period.

Next, the operation of the LPC inverse filter 3 shown in FIG. 3 will be described more detail. It will be assumed hereby that the speech signal $x_{i-10}$ supplied from the A/D convertor 1 is inputted to the unit delay element 31-1. Here, $x_{i-10}$ represents a sample value which is 10th sample time point value previous to a sample time point i. The unit delay element 31-1 stores $x_{i-10}$ and outputs it to the unit delay element 31-2 for storing it when the speech signal $x_{i-9}$ is inputted to the unit delay element 31-1. Thereafter, the speech signals $x_{i-8}, x_{i-7}, \ldots, x_{i-1}$ are sequentially stored in the unit delay element 31-1. When the unit delay element 31-1 stores $x_{i-1}$, the unit delay elements 31-2 to 31-10 store the speech signals $x_{i-2}, x_{i-3}, \ldots, x_{i-10}$, and the speech signal $x_i$ is supplied to the adder 34. The outputs of the unit delay elements 31-1 to 31-10 are supplied to the multipliers 32-1 to 32-10, respectively. The multipliers 32-1 to 32-10 multiply $x_{i-1}, \ldots, x_{i-10}$ supplied thereto by the $\alpha$ parameters $\alpha_1, \alpha_2, \ldots, \alpha_{10}$ and output the result to the adder 33. The output $x_i$ of the adder 33 expressed by the formula (3) is supplied to the adder 34. Here, $x_i$ is a prediction value of the speech signal $x_i$.

$$\hat{x}_i = \sum_{j=1}^{10} \alpha_j x_{i-j} \quad (3)$$

The adder 34 determines the residue $e_i (= x_i - x_i)$ and outputs it to the pitch excitation time analyzer 7 as described already.

Now, the present invention will be explained in further detail with reference to FIG. 1. The LPC analyzer 4 supplies the 10-order $\alpha$ parameters that have been analyzed to the LSP analyzer 5. The LSP analyzer 5 derives the 10-order LSP coefficients from the LPC coefficient by a known method such as a method which solves a higher order equation with LPC coefficient by utilizing the Newoton's recursive method or a zero point search method (this embodiment utilizes the former) and supplies them to the waveform generator 6.

Figure 4:
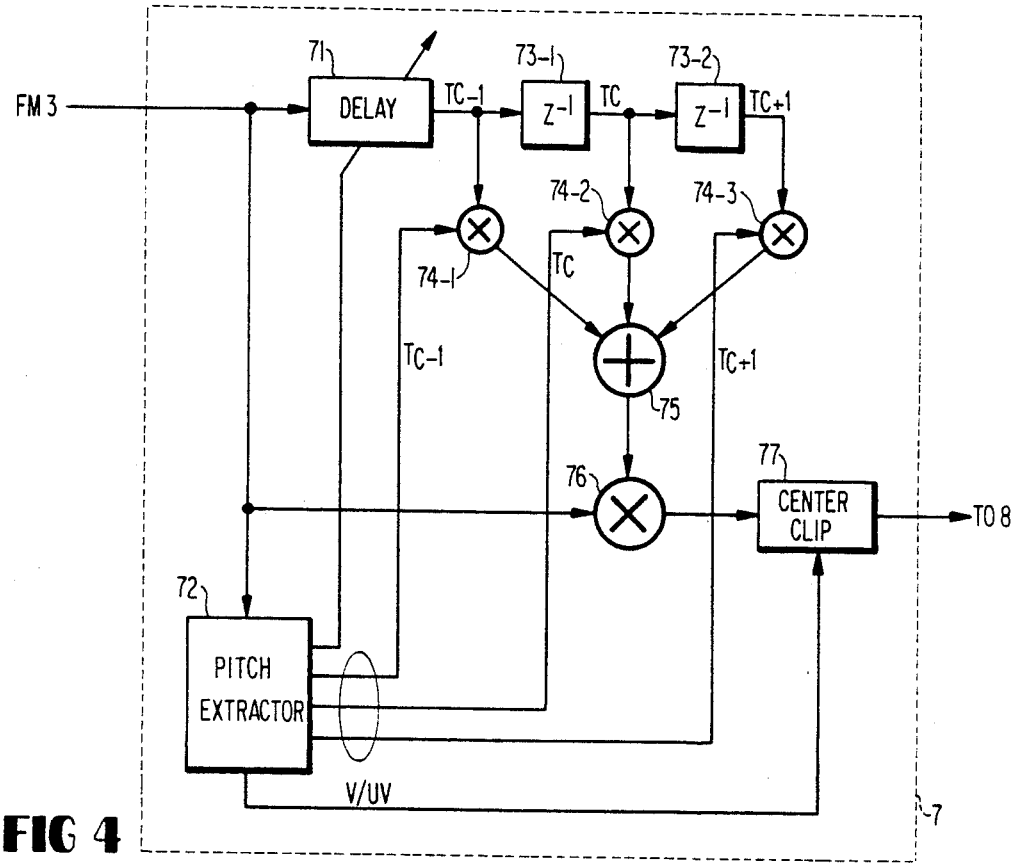
FIG. 4 is a block diagram showing in detail a pitch excitation time analyzer 7 shown in FIG. 1.

FIG. 4 is a detailed block diagram showing the pitch excitation time analyzer 7. This pitch excitation time analyzer 7 consists of a delay circuit 71, a pitch extracter 72, unit delay elements 73-1, 73-2, multipliers 74-1, 74-2, 74-3, an adder 75, and a multiplier 76.

The pitch extracter 72 determines the autocorrelation coefficient $R_j$ ($j=0, 1, \ldots, I$; where I is an integer corresponding the maximum value of the distribution range of the pitch period and is predetermined) on the basis of the residual waveform $e_i$ supplied from the LPC inverse filter 3 in the same way as the autocorrelation analyzer 2 described already. The pitch extracter 72 searches the maximum value of $R_j$ in the distribution range (2.5 to 15 msec in this embodiment) of the pitch period of $R_j$ thus determined. It is empirically known that the time slot number $T_c$ of the delay time corresponding to this maximum value is in substantial agreement with the pitch period.

Since the speech signal has pitch periodicity, that is, predictability, the residual waveform has predictability. Assuming that the residual waveform value $e_{i+T_c}$ is predictable by the residual waveform values $e_{i-1}$, $e_i$ and $e_{i+1}$ of the total three taps, the $e_{i+T_c}$ is expressed by the formula (4), where $e_i$ represents value at the tap one pitch period prior to the time point $i+T_c$.

$$e_{i+T_c} - d_{i+T_c} = \beta_1 e_{i+1} + \beta_2 e_j + \beta_3 e_{i-1} \quad (4)$$

In the formula (4), $\beta_1$ to $\beta_3$ are coefficients representing predictability of the residual waveform in the pitch delay time and are called "pitch prediction coefficients", and $d_{i+T_c}$ represents a residual value determined by the coefficients $\beta_1$ to $\beta_3$ at the time point $i+T_c$. The following formulae (5) to (7) are derived from the formula (4):

$$e_{i+T_c} \cdot e_{i+1} - d_{i+T_c} \cdot e_{i+1}$$

$$=\beta_1 e_{i+1}\cdot e_{i+1}+\beta_2 e_1\cdot e_{i+1}+\beta_3 e_{i-1}\cdot e_{i+1} \quad (5)$$

$$e_{i+T_c}e_i-d_{i+T_c}\cdot e_i$$
$$=\beta_1 e_{i+1}\cdot e_i+\beta_2 e_i\, e_i+\beta_3 e_{i-1}\cdot e_i \quad (6)$$

$$e_{i+T_c}\cdot e_{i-1}-d_{i+T_c}\cdot e_{i-1}$$
$$=\beta_1 e_{i+1}\cdot e_{i-1}+\beta_2 e_i\cdot e_{i-1}\beta_3 e_{i-1}\cdot e_{i-1} \quad (7)$$

It will be assumed hereby that the predicted residual waveform $e_i$ has steadiness and that the residual waveform $d_{i+Tc}$ and the predicted residual waveform are irrelevant to each other. This assumption hardly renders any practical problem in speech processing.

These formulae (5), (6) and (7) represent the relational formulae between the original speech waveform and the waveform to be reproduced through the three pitch prediction coefficients $\beta_1$, $\beta_2$ and $\beta_3$, and these waveforms are associated with each other by an equation based on the waveform multiplication value at the corresponding time point between both waveforms. The coefficients $\beta_1$, $\beta_2$ and $\beta_3$ are determined by obtaining these coefficients which make minimum difference between the original residual waveform and the reproduced prediction residual waveform expressed by these three equations. The solution is obtained on the basis of least squares method. However, since the formulae (5), (6) and (7) are expressed in the form of the vector product of the waveform multiplication, they must once be converted to the speech electric power so as to make it possible to apply the method of least squares.

Waveform multiplication is the same as a determination of autocorrelation in this case, and the formulae (5), (6) and (7) can be converted to the following formulae (8), (9) and (10) by integrating i:

$$R_{Tc-1}=\beta_1 R_0+\beta_2 R_1+\beta_3 R_2 \quad (8)$$

$$R_{Tc}=\beta_1 R_1+\beta_2 R_0+\beta_3 R_1 \quad (9)$$

$$R_{Tc+1}=\beta_1 R_2+\beta_2 R_1+\beta_3 R_0 \quad (10)$$

In the formulae (8), (9) and (10), $R_0$, $R_1$, $R_2$, $R_{Tc-1}$, $R_{Tc}$ and $R_{Tc+1}$ are autocorrelation coefficients at the delay 0, 1, 2, $T_c-1$, $T_c$ and $T_c+1$ of the predicted residual waveform $e_i$, respectively. The following formula (11) is derived from the formulae (8), (9) and (10):

$$\begin{bmatrix} R_0 & R_1 & R_2 \\ R_1 & R_0 & R_1 \\ R_2 & R_1 & R_0 \end{bmatrix}\begin{bmatrix} \beta_1 \\ \beta_2 \\ \beta_3 \end{bmatrix}=\begin{bmatrix} R_{Tc-1} \\ R_{Tc} \\ R_{Tc+1} \end{bmatrix} \quad (11)$$

The pitch extracter 72 calculates the pitch prediction coefficients $\beta_1$, $\beta_2$ and $\beta_3$ on the basis of the formula (11). The autocorrelation pitch extractor 72 outputs the calculated coefficients $\beta_1$, $\beta_2$, $\beta_3$ to the respective multipliers 74-1, 74-2, 74-3 and at the same time, the pitch period data $T_c-1$ to the delay circuit 71.

The pitch extractor 72 further extracts the V(Voiced)/ UV(Unvoiced) information by utilizing the pitch prediction coefficients $\beta_1$ to $\beta_3$ and the autocorrelation coefficient $R_0$ at the delay 0 and outputs it to the center clip circuit 77. The pitch prediction coefficients of the period $T_c$ obtained by this pitch extraction are delivered to the multipliers 74-2, 74-3, 74-1 as the sample data at the timings of $T_c$ and $T_c\pm1$, respectively.

Each of the unit delay elements 73-1, 73-2 delays the input for a delay time corresponding to one tap and the delay circuit 71 delays the input for $T_c-1$ every pitch period data. Therefore, the signal between the unit delay elements 73-1 and 73-2 is that of the time position $T_c$, the output of the delay circuit 71, that of the time position $T_c-1$ and the output of the unit delay element 73-2, that of the time position $T_c+1$.

Figure 5A:
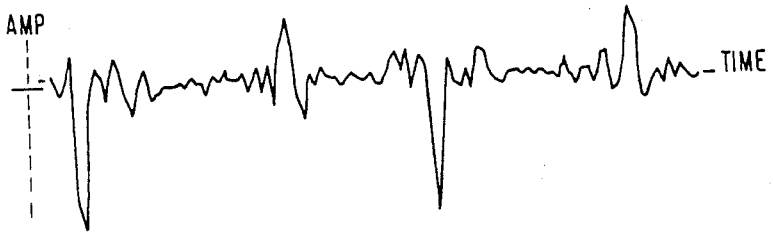
FIGS. 5A through 5D are waveform diagrams useful for explaining the operation of the pitch excitation time analyzer 7.
Figure 5B:
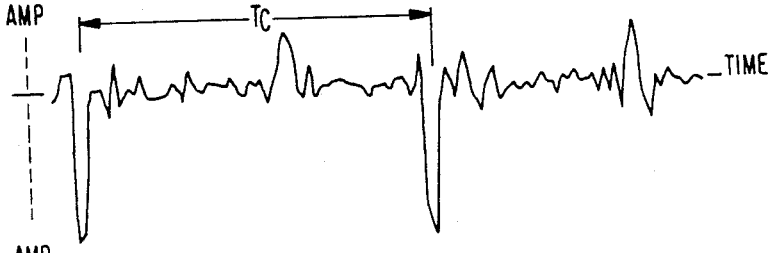
Figure 5C:
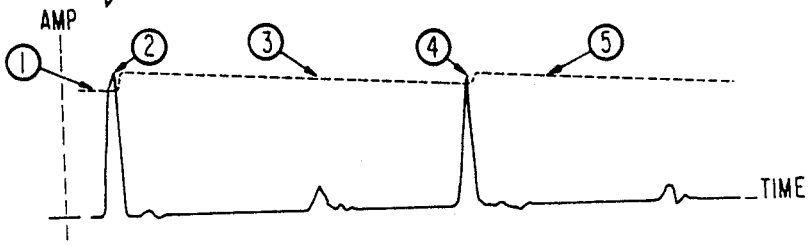

FIGS. 5A and 5B schematically show the residual waveform $e_j$ from the LPC inverse filter 3 and the ideal output of the adder 75 prepared by the pitch prediction coefficients $\beta_1$to $\beta_3$. The output of the multiplier 76 is the product of the instantaneous values of these waveforms shown in FIGS. 5A and 5B at the same timing. FIG. 5C shows the output waveform of the multiplier 76. In this output waveform the pitch component contained in the residual waveform is stressed and the polarity of the pitch component is always converted to a positive valve so that pitch extraction is extremely easy. This output waveform is supplied to the center clip circuit 77.

Figure 6:
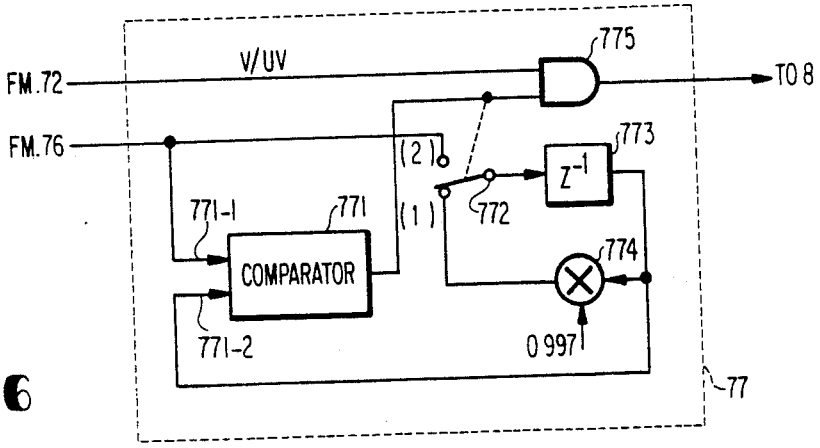
FIG. 6 is a detailed block diagram of a center clip circuit 77 shown in FIG. 4.

FIG. 6 is a detailed block diagram showing the construction of the center clip circuit 77. The center clip circuit 77 shown in FIG. 6 consists of a magnitude comparator 771, a switch 772, a unit delay element 773, a multiplier 774 and an AND gate 775.

First of all, the loop formed by the unit delay element 773 and the multiplier 774 will be explained. When the switch 772 is OFF, the output of the multiplier 774 is connected to the input of the unit delay element 773. It will be assumed hereby that the unit delay element 773 stores therein the data $v_i$ at the time i. This value $v_i$ and a constant 0.997 are fed to the multiplier 774. Since the output 0.997 $v_i$ ($=0.997\cdot v_i$) of the multiplier 774 is fed to the unit delay element 773, the output $v_{i+1}$ of the unit delay element 773 at the time i+1 is 0.997 $v_i$ and its output at the time i+2 is $0.9972^2$ $v_i$ ($=0.997\cdot0.997$ $v_i$). Similarly, its output $v_{i+n}$ at the time i+n is given by the following formula:

$$v_{i+n}=0.997^n\, v_i \quad (12)$$

Figure 5D:
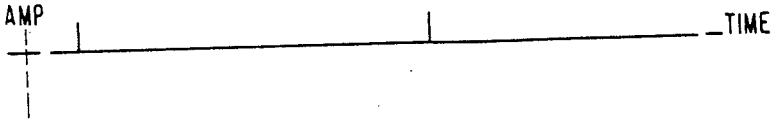

Now, the output of the unit delay element 773 is supplied to the input terminal 771-2 of the magnitude comparator 771. Dotted line represented by 1 in FIG. 5C is the output of the unit delay element 773. The waveform shown in FIG. 5C is supplied to the other input terminal 771-1 of the magnitude comparator 771 from the multiplier 76. The magnitude comparator 771 compares the magnitude of these two inputs and under the condition that the input of the 771-1 is greater than the input of the 771-2, it generates the "1" level and when the condition is not satisfied, it generates the "0" level. The output of the magnitude comparator 771 is shown in FIG. 5D. When this output generates the "1" level, the switch 772 is ON and the waveform shown in FIG. 5C is fed to the unit delay element 773. As a result, after the time advances by "1", the unit delay element 773 stores the peak represented by ② in FIG. 5C and the output of the magnitude comparator becomes "0". Since the peak thus stored is damped as represented by the formula (12), the input of the magnitude comparator 771 shown in ③ of FIG. 5C is prepared. The similar operation is effected also for the other peak ④ in FIG. 5C and ⑤ is prepared. On the other hand, output of the magnitude comparator 771 in FIG. 5D is supplied to the AND gate 775. The AND gate 775 utilizes the V/UV information supplied from the autocorrelation pitch extracter 72, prevents the generation of the unnecessary output from the center clip circuit 77 when the signal indicates unvoiced (UV) and generates the output only when the signal indicates voiced (V).

Figure 7:
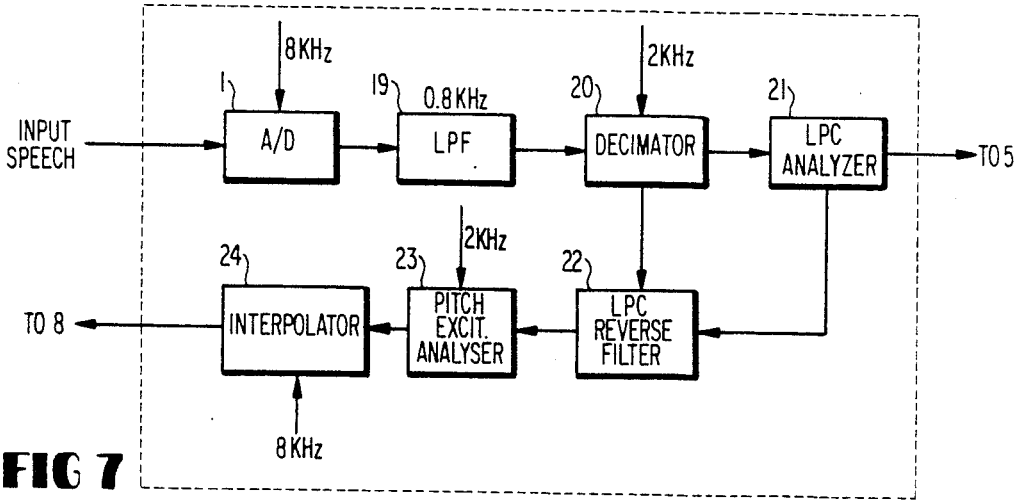
FIG. 7 is a block diagram showing a second embodiment of pitch excitation time analysis.

FIG. 7 is a block diagram showing the second embodiment of pitch excitation time analysis. The content shown in FIG. 7 is another embodiment for embodying the portion represented within the dotted line in FIG. 1 and consists of an A/D convertor 1, an LPF 19, a decimator 20, an LPC analyzer 21, an LPC inverse filter 22, a pitch excitation time analyzer 23 and an interpolator 24. The pitch time analysis in this case is directed to effect decimation for the digitized speech signals, that is, thin-out sampling, and to analyze the pitch excitation time of the decimated sample signals. It can drastically reduce the calculation quantity.

The 8 KHz sampled signal from the A/D converter 1 is supplied to LPF 19 and subjected to filtration using 0.8 KHz as a high cut-off frequency.

The output of LPF 18 is subjected to decimation by 2 KHz frequency to pick up one out of four samples of 8 KHz sampling frequency and supplies its output to the LPC analyzer 21.

The LPC analyzer 21 makes the LPC analysis for the input in the period of the analysis frame to extract the 4-order $\beta$ parameters and supplies them as the filter coefficients to the LPC inverse filter 22. The LPC inverse filter 22 supplies the residual waveform to the excitation time analyzer 23.

The pitch excitation time analyzer 23 has fundamentally the same construction as that of the pitch excitation time analyzer 7 shown in FIG. 4 but is different from the latter in that the former is driven by 2 KHz. This analyzer 23 outputs the pitch excitation time for the 2 KHz decimation sample in the form of a pulse train and supplies the pulse train to the interpolator 24. The interpolator 24 samples the input at 8 KHz to interpolate the pulse train of the 2 KHz sample data.

Turning back to FIG. 1, the output of the pitch excitation time analyzer 7 is supplied to the pitch excitation time thin-out unit 8. The thin-out unit 8 thins out the pitch excitation time, that is, the pitch pulse train supplied from the pitch excitation time analyzer 7, at a predetermined thin-out ratio in order to reduce the quantity of analysis calculation and the transmission data rate.

Figure 8:
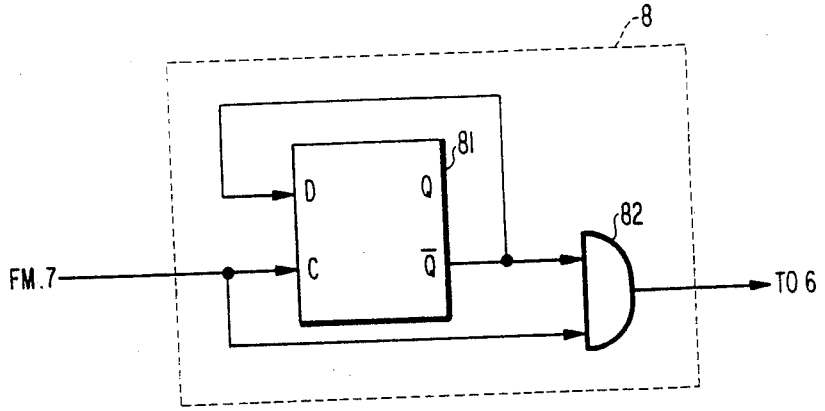
FIG. 8 is a detailed block diagram of a pitch excitation time thining-out unit 8 shown in FIG. 1.

Referring to FIG. 8, the pitch excitation time thin-out unit 8 consists of the combination of a D-type flip-flop 81 and an AND circuit 82. The unit 8 thins out the pitch pulse at the pitch excitation time by a predetermined thin-out ratio or ½ in this embodiment whenever the AND condition of the input of the AND circuit 82 is satisfied, and supplies this thinned-out pitch excitation time to the waveform generator 6.

Figure 9:
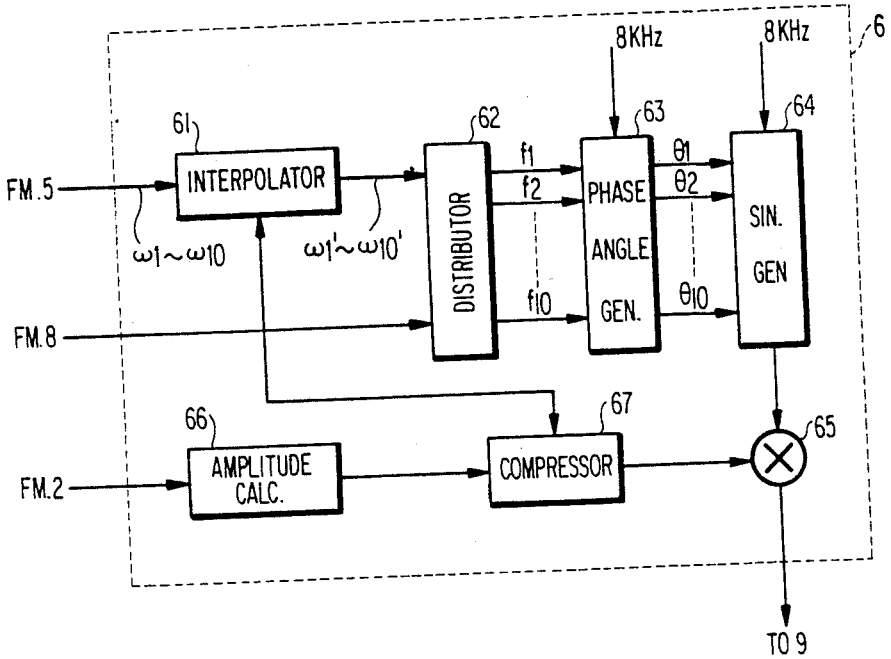
FIG. 9 is a detailed block diagram of a waveform generator 6 shown in FIG. 1.

FIG. 9 is a detailed block diagram showing the waveform generator 6. The waveform generator 6 consists of an interpolator 61, a distributor 62, a phase angle generator 63, a sinusoidal wave generator 64, a multiplier 65, an amplitude calculator 66 and a band compressor 67.

The waveform generator 6 generates signals of the sinusoidal waves respectively assigned to the LSP coefficients. These generated signals include two arbitrary different frequency waveforms corresponding to the LSP frequencies continuously connected in synchronism with the pitch excitation time. In other words, two sinusoidal waves are continuously connected at the pitch excitation time, and this connected point is arranged to be the point of phase change of the line spectrum expressed by the sinusoidal wave.

The LSP coefficients $\omega_1$ to $\omega_{10}$ from the LSP analyzer 5 are generally distributed in $\omega_1$: 100~400 Hz, $\omega_2$: 150–700 Hz, . . . , $\omega_{10}$: 2300–3300 Hz. The interpolator 6 makes data interpolation in order to minimize any loss of the original information even when these LSP coefficients are sampled at the thin-out pitch excitation time and supplies them as the interpolated LSP coefficients $\omega'_1$ to $\omega'_{10}$ to the distributor 62.

Figures 10A, 10B, 10C, 11:
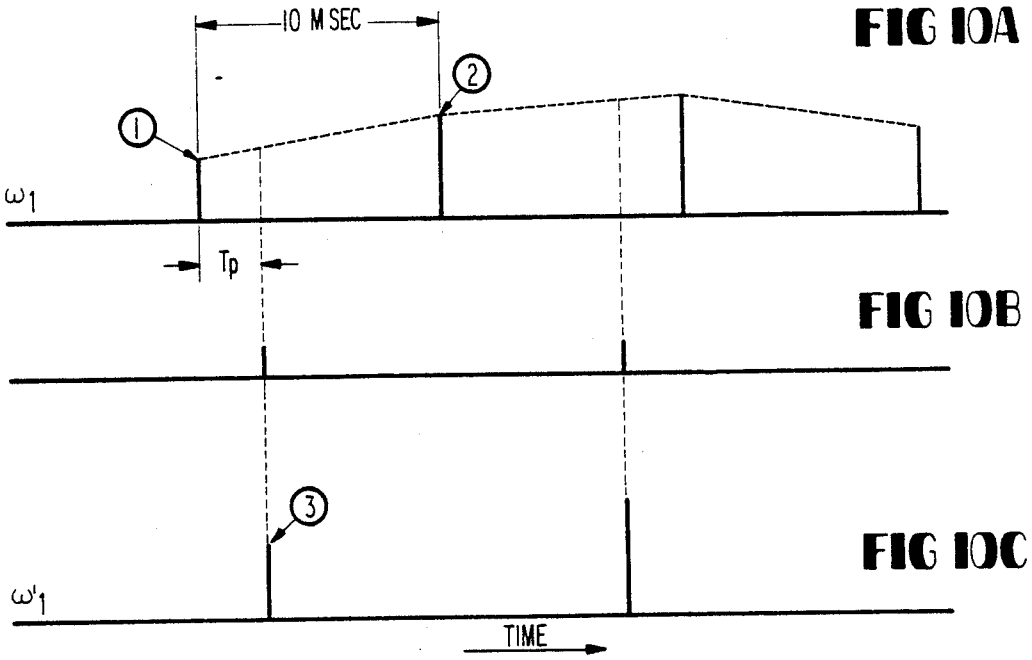
FIGS. 10A through 10C are explanatory views useful for explaining the operation of an interpolator 61 shown in FIG. 9.
FIG. 11 is a diagram showing an example of frequency distribution by a distributor 62 shown in FIG. 9.

FIG. 10 is a diagram useful for explaining this interpolation process. For example, the LSP coefficient $\omega_1$ is determined for each analysis frame (10 msec) as $\omega_1(1)$, $\omega_2(1)$, . . . (FIG. 10A). Since this timing of the pitch excitation time (FIG. 10B) is not coincident with the analysis frame timing, the value $\omega'_1(1)$ at the timing of the thin-out excitation time is obtained from the following formula using $\omega_1(1)$ and $\omega_1(2)$ as the interpolation values (FIG. 10C):

$$\omega'_1(1) = \frac{\omega_1(1) \times (10 - Tp) \times \omega_1(2) \times Tp}{10}$$

In similar way, the interpolated values $\omega'_2$ to $\omega'_{10}$ are obtained.

On the other hand, the thin-out pitch excitation time supplied from the pitch excitation time thin-out unit 8 is applied to the interpolator 61 and the distributor 62 for pitch synchronization processing.

The distributor 62 generates (distributes) frequency signals $f_1$ to $f_{10}$ each of which is made to correspond to one of the interpolated LSP coefficients $\omega'_1$ to $\omega'_{10}$ for each of the frames determined by the thinned-out pitch excitation time so that the ten frequencies of the LSP coefficients $\omega'_1$ to $\omega'_{10}$ are any of $f_1$, $f_2$, . . . , $f_{10}$ at a predetermined switch distribution basis. If the frequency $\omega'_1$ is made to correspond to $f_1$for example, the frequency $\omega'_2$ is made to correspond to a frequency other than $f_1$, for example, $f_2$. For the other frequencies $\omega'_3$ to $\omega'_{10}$ are likewise made to correspond to frequencies $f_3$ to $f_{10}$. Here, $f_1$ to $f_{10}$ may be changed for each frame determined by the pitch excitation time. For instance, at a certain pitch excitation time, distribution is made in such a manner as to establish correspondence $f_1 \rightarrow \omega'_1$, $f_2 \rightarrow \omega'_2$, $f_3 \rightarrow \omega'_3$, . . . , $f_i \rightarrow \omega'_i$, $f_j \rightarrow \omega'_j$ and a subsequent excitation time point, $f_1 \rightarrow \omega'_2$, $f_2 \rightarrow \omega'_1$, $f_3 \rightarrow \omega'_4$, $f_4 \rightarrow \omega'_j$, . . . , $f_i \rightarrow \omega'_j$, $f_j \rightarrow \omega'_i$, . . . and so forth. In this embodiment, distribution is switched between the pair of frequencies such as between $f_1$ and $f_2$, but any combination can be used. In other words, it is only necessary that distribution is changed at the pitch excitation time but it is not much important how the change is made, for it is possible on the synthesis side to reproduce the pitch excitation time only from the phase change of the LSP frequency that occurs due to the distribution change at the pitch excitation time. FIG. 11 shows an example of the frequency distribution. I, II, III and IV represent the state of time intervals (frame) between two pitch excitation times.

Figure 12:
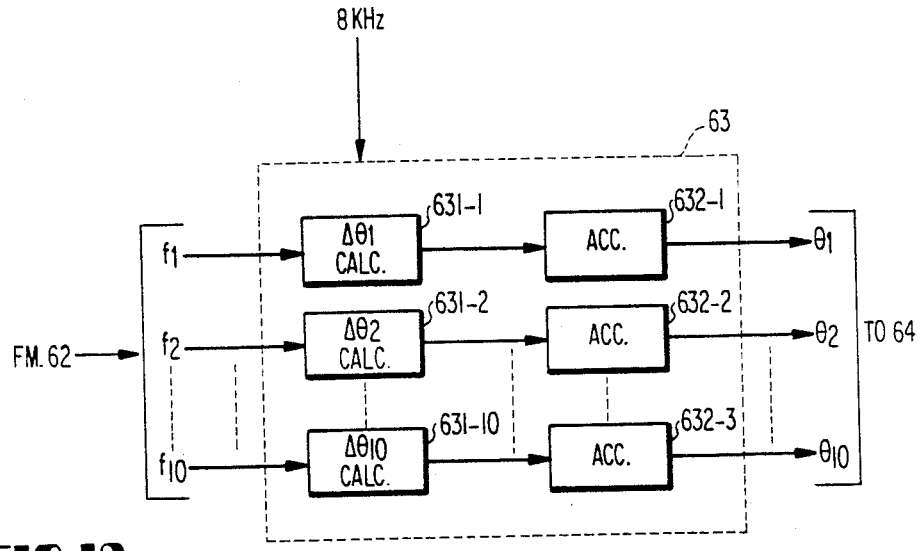
FIG. 12 is a detailed block diagram of a phase angle generator 63 shown in FIG. 9.

Now, the output for each frame produced as a result of the distribution $f_1$ to $f_{10}$ is then inputted to the phase angle generator 63. FIG. 12 is a block diagram showing in detail the phase angle generator 63. It consists of a $\Delta\theta_1$ calculator 631-1, a $\Delta\theta_2$ calculator 631-2, . . . a $\Delta\theta_{10}$ calculator 631-10 and accumulators 632-1, 632-2 . . . , 632-10.

The $\Delta\theta_1$ calculator 631-1 measures the phase shift quantity $\Delta\theta_1$ between the 8 KHz samples of the $f_1$ signals. The accumulator 632-1 functions as an integrator and accumulates $\Delta\theta_1$ at an integration maximum range of 360°. When the quantity thus accumulated reaches 360°, it becomes zero and accumulation is again performed from zero. Thus accumulated phase angles $\theta_1$ to $\theta_{10}$ are then supplied to the sinusoidal wave generator 64.

Figure 13:
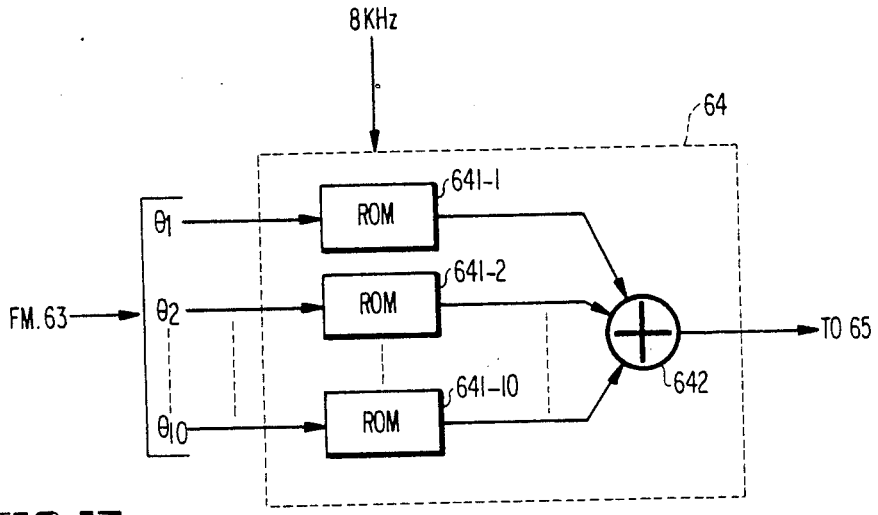
FIG. 13 is a detailed block diagram showing a sinusoidal wave generator 64 shown in FIG. 9.

FIG. 13 is a detailed block diagram showing the sinusoidal wave generator 64 consisting of ROMs 641-1, 642-2, . . . , 641-10 and an adder 642.

Figures 14A, 14B, 14C, 14D, 14E, 14F, 14G:
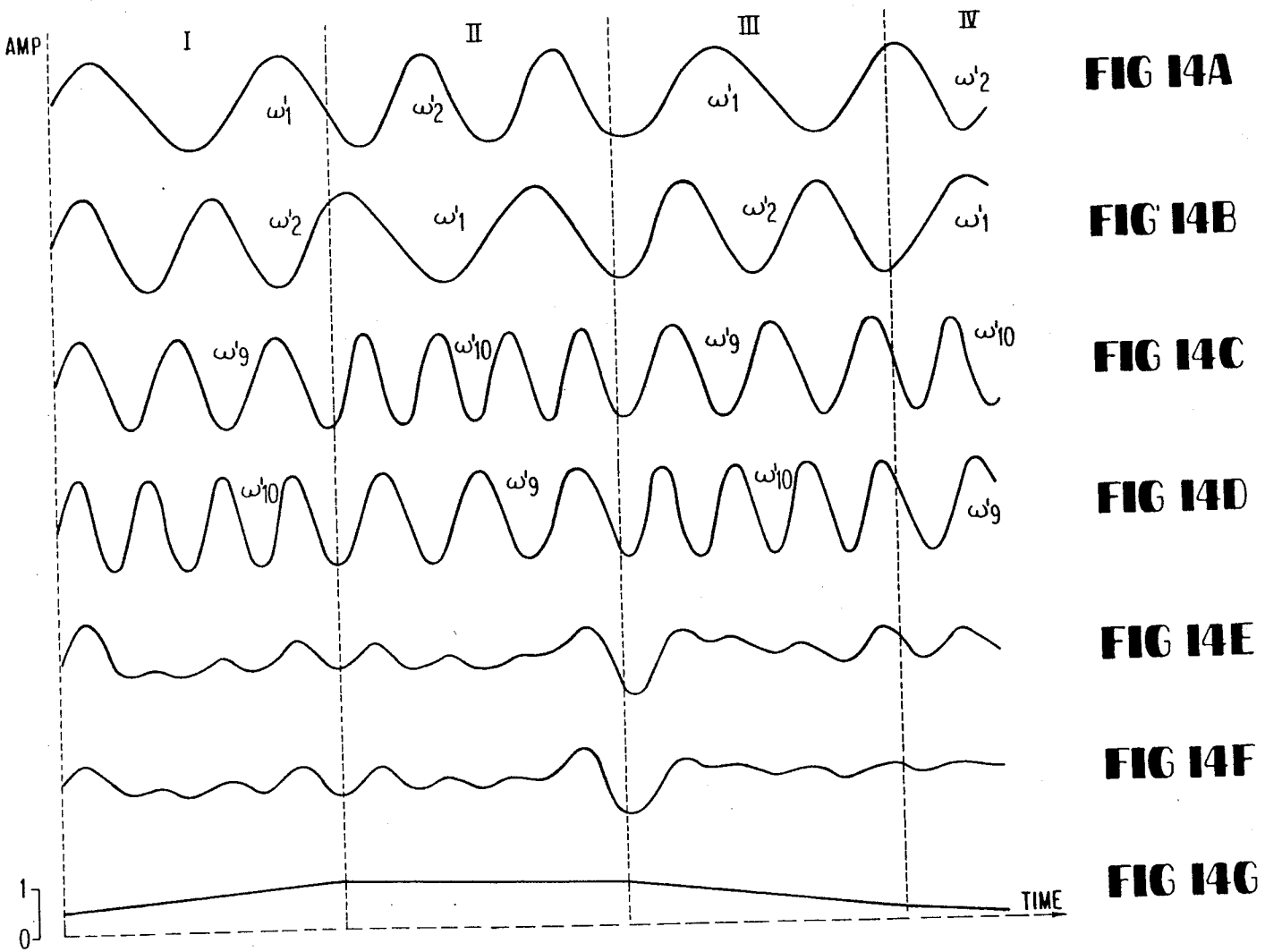
FIGS. 14A through 14C are explanatory views useful for explaining the operation of the circuit shown in FIG. 13.

In response to the input phase angle $\theta_1$, the sinusoidal wave data corresponding to the phase angle $\theta_1$ is read out from ROM 641-1. ROM 641-1 stores in advance the sinusoidal wave data corresponding to the value of the phase angle $\theta_1$. In exactly the same way, the sinusoidal wave data of the frequencies corresponding to the values of the phase angles $\theta_2$ to $\theta_{10}$ are read out from ROMs 641-1 to 641-10. All of the read out data from ROMs are added by the adder 642. FIGS. 14A, 14B, 14C and 14D show the output waveforms from ROMs 641-1, 641-2, 641-9 and 641-10 under the state shown in FIG. 11 and FIG. 14E shows the output waveform of the adder 64.

Now, the electric power data inputted from the autocorrelation analyzer 2 is supplied to the amplitude calculator 66 and amplitude data are obtained through the extraction of the square root, and the like. The amplitude data are then supplied to the band compressor 67 to compress the amplitude information at a predetermined ratio with the dynamic range being preserved and supply the compressed data (FIG. 14G) to the multiplier 65.

The multiplier 65 multiplies the linearly coupled sinusoidal wave data supplied from the sinusoidal wave generator 64 by compressed amplitude information and supplies the result to the D/A converter 9. FIG. 14F shows the output waveform of the multiplier 65. Continuously and linearly coupled ten sinusoidal wave frequencies are generated from the D/A converter 9. The thinned-out excitation time is outputted as the timing of the junction. LPF 10 removes the unnecessary high frequency components and the output is delivered to the transmission path 101.

Figure 15:
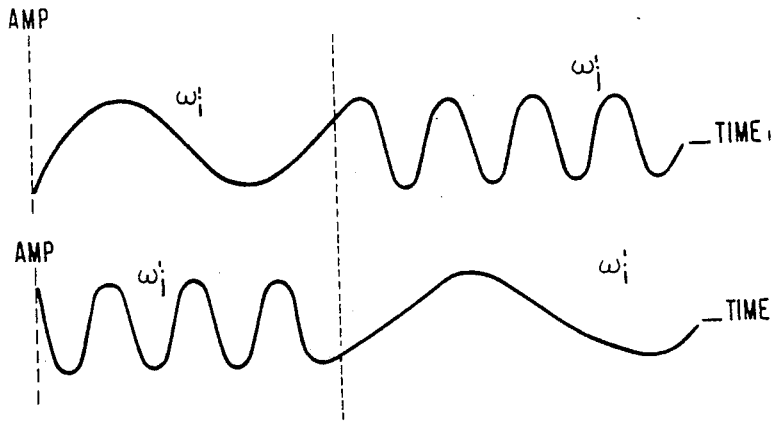
FIG. 15 is an output waveform characteristic diagram useful for explaining the features of the output waveform on the analysis side in FIG. 1.

FIG. 15 is an output wave form diagram useful for explaining the operation of the analysis side in FIG. 1. FIG. 15 shows the case where two frequencies $\omega'_i$ and $\omega'_j$ are coupled while keeping continuity, but the output waveform is expressed in practice in the form of coupled sinusoidal waves of ten frequencies that are determined in accordance with ten different LSP frequencies. In FIG. 15, two sinusoidal waves are shown which are linearly coupled from $\omega'_i$ to $\omega'_j$ and from $\omega'_j$ to $\omega'_i$ at the pitch excitation time. In the case of FIG. 1, the pitch excitation time is the thinned-out pitch excitation time. This $\omega'_i$ is the aforementioned $f_1$ and $\omega'_j$ is $f_2$, for example.

Though FIG. 15 shows the example of linearly coupled two sinusoidal waves of frequencies $\omega'_i$ and $\omega'_j$ that have extremely different frequencies from each other, the difference between the two adjacent frequencies to be coupled may not be so much great and their coupling may be made more smoothly. Therefore, frequency dispersion due to spectrum spread is by far smaller. In this way, it is possible to transmit the pitch information in the form of phase modulation of the LSP frequency at the pitch excitation time. In other words, the frequency value of $f_1$ changes from $\omega'_i$ to $\omega'_j$ before and after the pitch excitation time and similarly, the frequency value of $f_2$ changes from $\omega'_j$ to $\omega'_i$, and both of these $f_1$ and $f_2$ keep continuity of the waveform. However, when $\omega'_i$ or $\omega'_j$ is taken into consideration and regarded as a waveform, the phase of such a waveform is discontinuous at the pitch excitation time.

Figure 16:
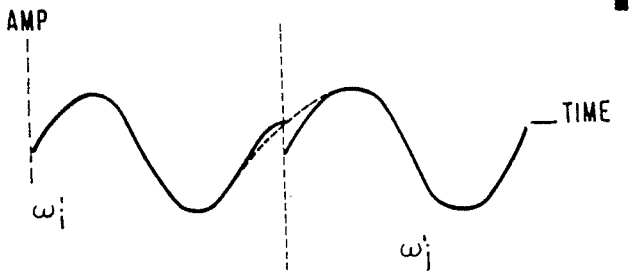
FIG. 16 is a pitch excitation time phase modulation characteristic diagram useful for explaining the fundamental features of phase modulation in the pitch excitation time.

FIG. 16 is a characteristic diagram of pitch excitation time phase modulation. When phase modulation is effected at the pitch excitation time, a discontinuous state is brought forth, though varying to some extent, as represented by solid line, so that spectrum spread is unvoidable. This embodiment solves the problem by effecting linear coupling of two frequencies at the pitch excitation time so as to keep continuity of the waveform as shown in the dotted line. The phase modulation system shown either in FIG. 15 or FIG. 16 may be selected arbitrarily in consideration of the transmission capacity, the object of transmission, and so forth.

Next, the processing on the synthesis side will be explained with reference to FIG. 2.

Figure 17:
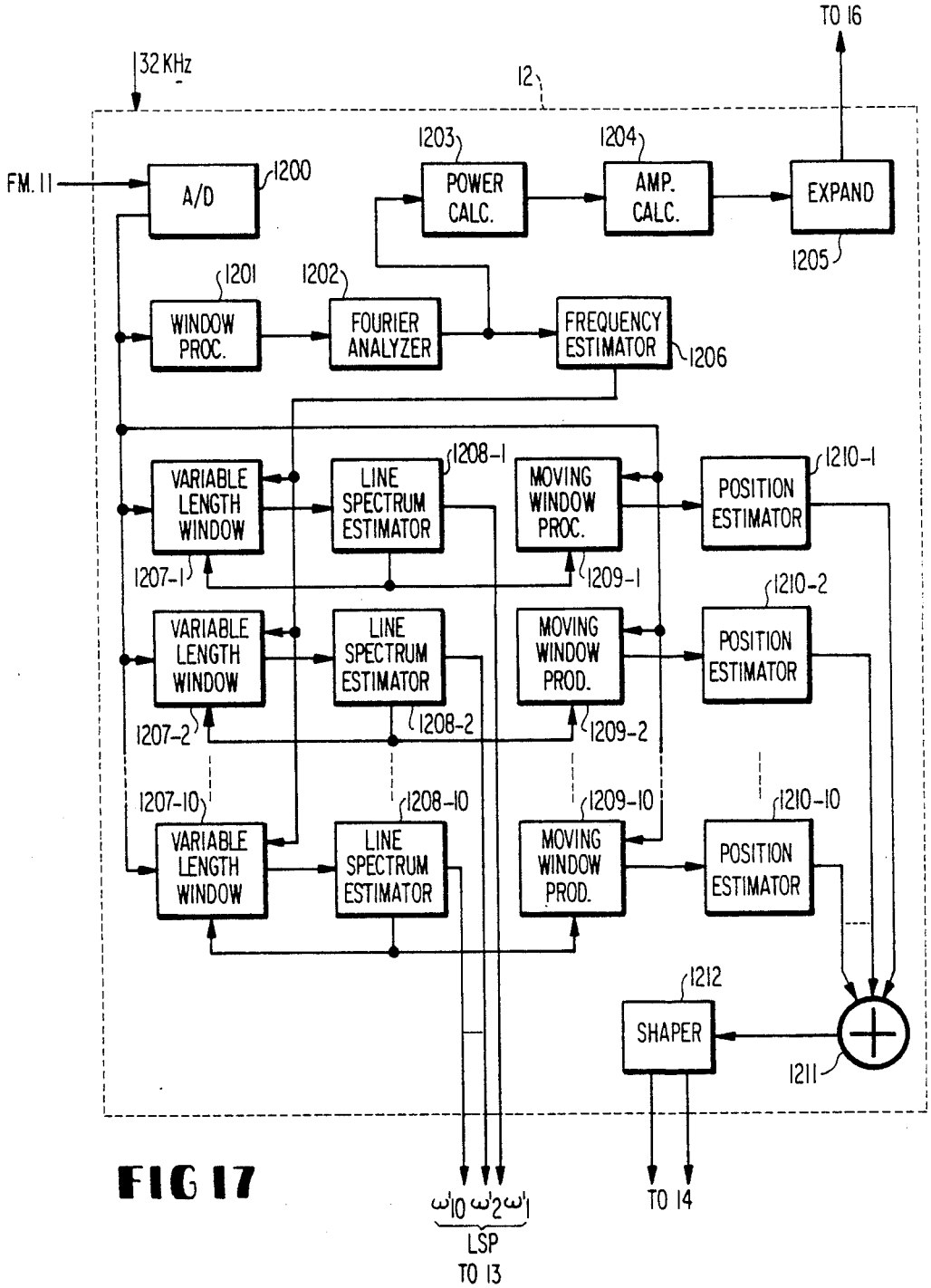
FIG. 17 is a detailed block diagram showing a parameter-time reproducer 12 shown in FIG. 2.

The signal inputted through the transmission path 101 is supplied to the parameter/time reproducer 12 after its unnecessary high band components are removed by LPF 11. FIG. 17 is a block diagram showing in detail the parameter/ time reproducer 12.

The parameter/time reproducer 12 consists of an A/D converter 1200, a window processor 1201, a Fourier analyzer 1202, an electric power calculator 1203, an amplitude calculator 1204, an expander 1205, a frequency estimator 1206, variable length rectangular window processors 1207-1 to 1207-10, line spectrum estimators 1208-1 to 1208-10, moving window processors 1209-1 to 1209-10, position estimators 1210-1 to 1210-10, an adder 1211 and a pitch waveform shaping unit 1212. The reproducer 12 reproduces the LSP coefficient, the pitch time, V/UV information and the electric power information.

The signal from LPF 11 is converted to a digital data of a predetermined bit number, i.e. 12 bits with a 32 KHz sampling frequency by the A/D converter 1200. The sampling frequency is four times that of the analysis side in order to improve the accuracy in the reproduction processing of the parameters and time. Generally, the sampling frequency can be set arbitrarily in consideration of processing resolution.

The output of the A/D converter 1200 is supplied to the window processor 1201, the variable length rectangular window processors 1207-1 to 1207-10 and the moving window processors 1209-1 to 1209-10.

The window processor 1201 effects segmentation window processing which multiplies the input by the Humming function of the 32 msec window length for each analysis frame (FIG. 18A) and supplies it to the Fourier analyzer 1202. In FIG. 18A, ①, ② and ③ represent the Humming functions that are from another by 10 msec. The Fourier analyzer 1202 performs discrete Fourier transform on the input and supplies the result to the electric power calculator 1203 and the frequency estimator 1206.

The electric power calculator 1203 calculates the electric power by utilizing the Fourier transform data. The amplitude calculator 1204 determines the amplitude data through the extraction of the square root of the electric power and supplies it to the expander 1205. The amplitude expander 1205 expands the amplitude data to obtain the original amplitude and calculates the original electric power.

The frequency estimator 1206 receives the output (FIG. 18B) of the Fourier analyzer 1202 when the window ② of FIG. 18A is used, and estimates the approximate LSP frequencies $\omega'_1$, $\omega'_2$, $\omega'_3$, . . . $\omega'_{10}$ by searching the level of the output from the analyzer 1202 as shown in FIG. 18B. In the case of this embodiment, 10 data relating to the approximate LSP frequencies corresponding to the LSP coefficients $\omega'_1$ to $\omega'_{10}$ are selected. The variable length rectangular window processors 1207-1 to 1207-10 determine the window length of the rectangular function for the window processing on the basis of the LSP frequency data. Generally, when the waveform to be analyzed is segmented by a window length of one period or several multiplied periods of the waveform, the analyzed result is not affected by segmentation. Assuming that one specific frequency is selected from 10 LSP frequencies, a waveform which contains all these 10 LSP frequencies is segmented by the window length coincident with the period of this frequency and discrete Fourier transform is made for thus segmented data. In this case, at least the selected one frequency signal is not affected by segmentation so that a complete line spectrum is obtainable. Due to the influences of segmentation, the other line spectrum signals obtained is somewhat frequency-spread. The variable length window processors 1207-1 to 1207-10 are used to correctly analyze one specific wave of the LSP frequency. Each variable length rectangular window processor receives the information on the approximate LSP frequency to determine the window length and makes window processing on the signal from the A/D converter 1200 by the rectangular function. FIGS. 18C and 18D show the windows that are determined in response to the frequencies $\omega'_1$ and $\omega'_2$ that are estimated.

While the variable length rectangular functions thus determined overlap with one another for each channel in predetermined frequency ranges.

The line spectrum estimators 1208-1 to 1208-10 perform Fourier transform on the 32 KHz sampling data from the window processors 1207-1 to 1207-10 and estimate accurately the LSP frequencies $\omega'_1$ to $\omega'_{10}$. FIGS. 18E and 18F show the spectra of the frequencies $\omega'_1$ and $\omega'_2$ determined by the line spectrum estimators 1208-1 and 1208-2. Incidentally, whenever one line spectrum is estimated, the window length data is corrected on the basis of the estimated value and the corrected data is supplied to each variable length rectangular window processor. This correcting operation is repeated a predetermined number of times so as to improve the estimating accuracy of the line spectrum. Also, the finally determined window length data is provided to the moving window processors 1209-1 to 1209-10 in order to effect the later-appearing extraction processing of the pitch excitation time.

Figure 19A:
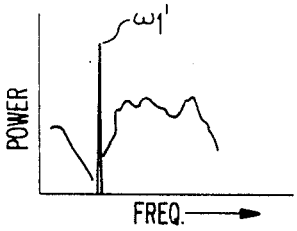
Figure 19B:
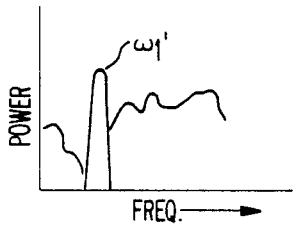
Figure 19C:
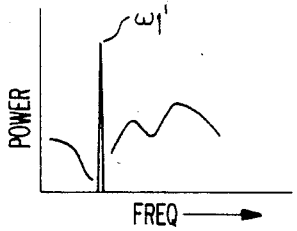
Figure 19D:
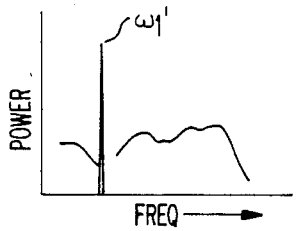

Now, the moving window processors 1209-1 to 1209-10 receive the 32 KHz sampling data of the A/D converter 1200, obtain the window length data relating to the rectangular window from the line spectrum estimators 1208-1 to 1208-10 and perform the moving window processing which segments the input 32 KHz sampling by the rectangular function of the window length data in a sweep range containing the phase modulation point while moving at a predetermined timing. FIGS. 18G to 18J show the windows that are moved. The position estimators 1210-1 to 1210-10 search or detect the phase modulation point by use of the data from the moving window processors by detecting the state in which remarkable blunting of the energy concentration of the line spectrum occurs. For example, the position estimator 1210-1 detects the signal spectra shown in FIGS. 19A–19D that have been subjected to window processing by the moving window processor 1209-1 with the window such as shown in FIGS. 18G, 18H, 18I and 18J, judges that the phase modulation point does not exist when substantially complete line spectra can be obtained as shown in FIGS. 19A, 19C and 19D, and judges that the phase modulation point is contained when the $\omega'_1$ spectrum is spread as shown in FIG. 19B. In this manner, the position estimators 1210-1 to 1210-10 accurately estimate the time position of the phase modulation point on the basis of the moving window processed data, and supplies it to the adder 1211 as the position pulse candidate corresponding to the pitch excitation time.

The 10-channel moving window processors 1209-1 to 1209-10 and the phase estimators 1210-1 to 1210-10 are arranged in order to remarkably improve the search or detection accuracy of the pitch pulse train by effecting the moving window processing and position estimation for the same pitch pulse train. In other words, these ten outputs are added by the adder 1211 to improve remarkably the S/N (signal-to-noise ratio) in the search of the pitch pulse.

Upon receiving the output of the adder 1211, the pitch wave shaping unit 1212 makes predetermined clipping and wave shaping and outputs the pulse train representing the pitch excitation time and the V/UV information in response to the existence of this pulse train.

The parameter/time reproducer 12 supplies the LSP coefficients thus reproduced to the LSP filter 13 and the data relating to the pitch excitation time, the V/UV information to the exciting source generator 14, and the electric power data to the multiplier 16, respectively.

The exciting source generator 14 generates the exciting source pulse of the normalization level on the basis of the data on the pitch excitation time and the V/UV information, and supplies it to the interpolator 15.

Figure 20:
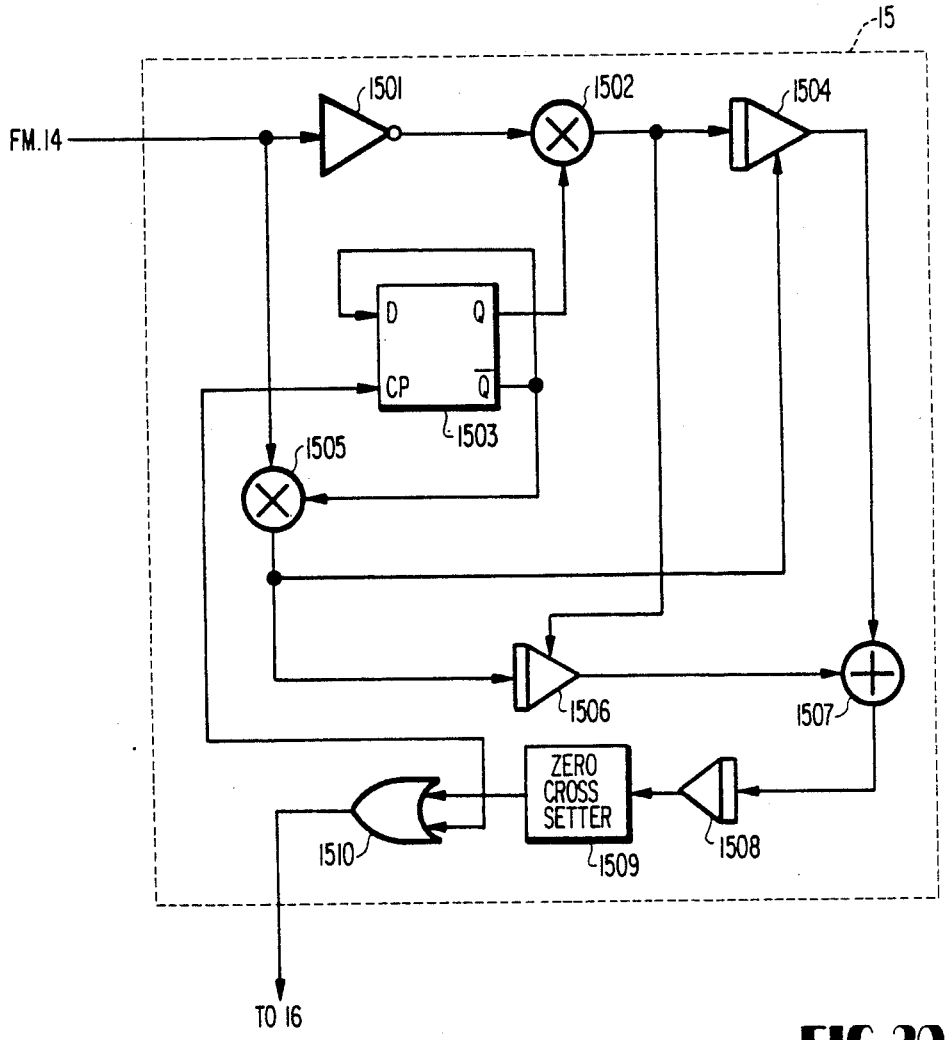
FIG. 20 is a block diagram of the interpolator 15 shown in FIG. 2.

FIG. 20 is a detailed block diagram showing the interpolator 15. Since the exciting source pulse from the exciting source generator 14 is thinned out to ½ from the original pitch excitation time pulse on the analysis side, the interpolator 15 makes an interpolation to restore the exciting source pulse to the original pulse. This interpolation is made by estimating the zero cross position at an intermediate position of the thin-out pulse train and sequentially raising the pulses one after another.

FIG. 21 shows the principal waveform diagram of the interpolator shown in FIG. 20. FIG. 20 will be explained with reference to FIG. 21.

The interpolator 15 shown in FIG. 20 consists of an inverter 1501, a multiplier 1502, a D-type flip-flop 1503, an integrator 1504, a multiplier 1505, an integrator 1506, an adder 1507, an integrator 1508, a zero cross setter 1509 and an OR circuit 1510.

The thinned-out input pulse (FIG. 21A) is supplied to the inverter 1501, the CP (clock) terminal of the D-type flip-flop 1503, the multiplier 1505 and the OR circuit 1501. The inverter 1501 inverts the polarity of the input pulse and supplies it to the multiplier 1502. It is shown as the inverter output 1501 in FIG. 21B.

The Q terminal output of the D-type flip-flop 1503 is also supplied to the multiplier 1502. This Q terminal output provides alternately the binary logic values "1" and "0" so that no output is produced from the multiplier 1502 when the logic value is "0". This output is supplied to the integrator 1504, and is shown as the output of the multiplier 1502 in FIG. 21C.

The $\overline{Q}$ terminal output of the D-type flip-flop 1503 produces "1" and "0" with polarities opposite to those of the Q terminal. Therefore, the output of the multiplier 1505 is shown as the output of the multiplier 1505 in FIG. 21D in comparison with the output of the multiplier 1502.

The output of the multiplier 1505 is supplied to the integrator 1506 and also to the integrator 1504 as a reset signal. Furthermore, the output of the multiplier 1502 is supplied as a reset signal to the integrator 1506.

Figures 21A, 21B, 21C, 21D, 21E, 21F, 21G, 21H:
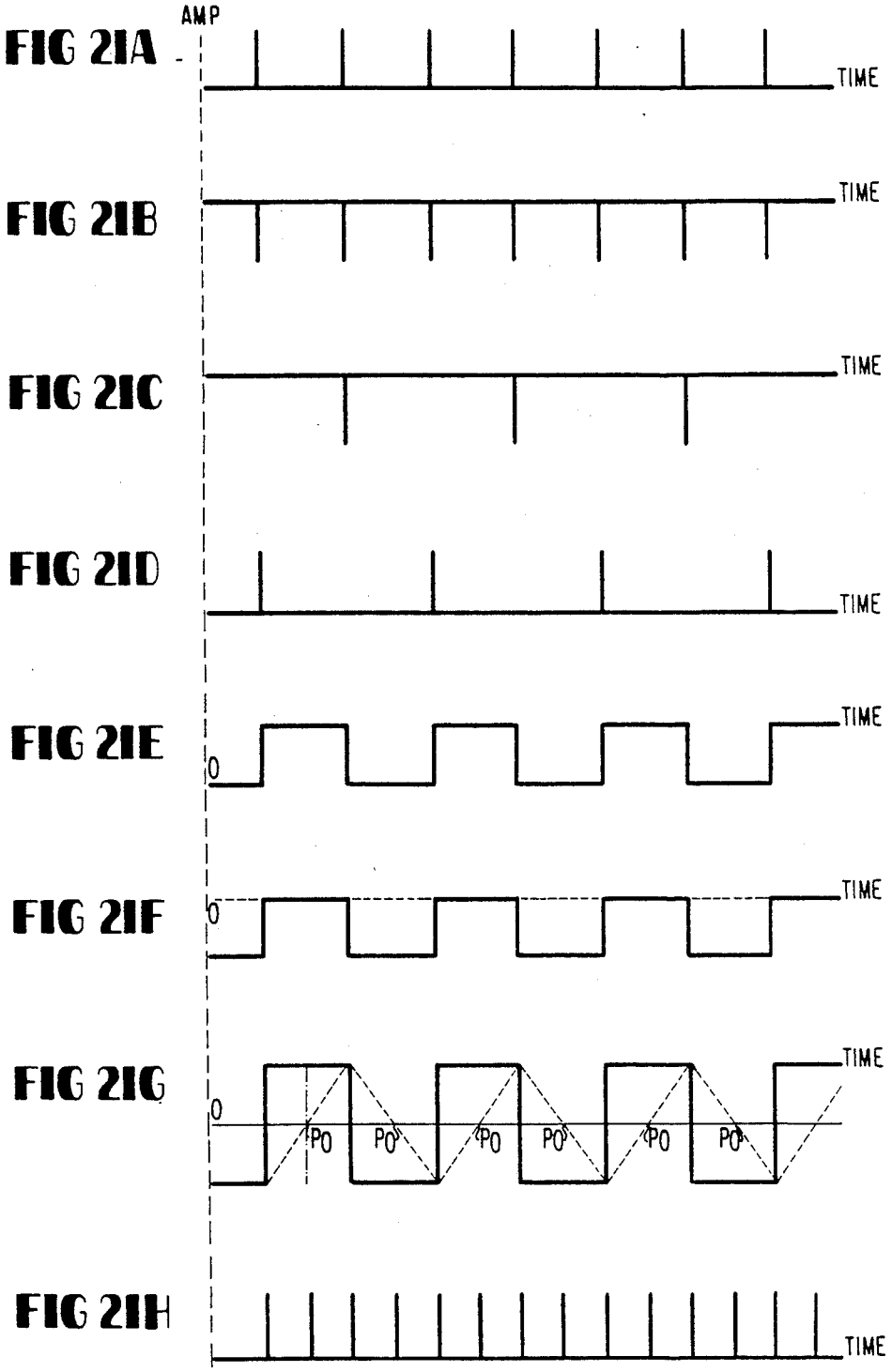
FIGS. 21A through 21H are waveform diagrams showing the principal operating waveforms of the interpolator shown in FIG. 20.

In this manner, the integrators 1506 and 1504 output the rectangular waveforms shown in FIGS. 21E and 21F, respectively.

The adder 1507 adds these two rectangular waves to obtain the adder 1507 output, passes it through the integrator 1508 and obtains the output of the integrator 1508 represented by a triangular wave of dotted line. These waves are shown in FIG. 21G.

The zero cross setter 1509 determines the zero cross point $P_0$ of the integrator 1508 output by utilizing a comparator or the like, generates the pulse at the timing corresponding to this zero cross point and supplies it to the OR circuit 1510.

The thinned-out pulse is inputted to the OR circuit 1501. Therefore, a pulse which is some multiplies of the thinned-out pulse is obtained as the interpolated pulse shown in FIG. 21H and the output of the OR circuit 1510 is restored to the pulse before the thin-out operation.

The output of the interpolator 15 is supplied to the multiplier 16 to be multiplied by the electric power supplied from the parameter/time reproducer 12. The multiplier 16 reproduces the exciting source of the input speech for each analysis frame and feeds it as the input to the LSP filter 13. This input is a reproduced exciting source including the pitch excitation time, and the output of the LSP filter 13 driven by this input becomes a digital synthesized sound having extremely high fidelity. The output of the LSP filter 13 is converted to the analog signal by the D/A converter 17. The unnecessary high band components are cut off by LPF 18.

Though the description has thus been given on the embodiment utilizing LSP as a plurality of line spectra, substantially the same method can be practised when other line spectra such as CSM are utilized in place of LSP.

Though the embodiment deals with the system which keeps continuity of the line spectra at the phase change time and the system which thins out and transmits the pitch excitation time, they can be practised arbitrarily in consideration of the transmission capacity of a transmission line, the object of operation of the system, and so forth.

What is claimed is:

1. A speech processing system comprising:

sampling means for sampling input speech at a first frequency and outputting a speech signal in digital form;

spectrum extraction means for extracting the spectrum information of said speech signal for each analysis frame of a predetermined time period as a plurality of line spectrum data;

first pitch position extraction means for extracting pitch position information of said speech signal for each analysis frame;

first amplitude extraction means for extracting amplitude information of said speech signal for each analysis frame;

frequency allotment means for generating sinusoidal wave signals having predetermined frequencies and allotting each of said sinusoidal wave signals to each of a plurality of said line spectrum data;

frequency control means for changing the frequencies of said sinusoidal wave signals, which are allotted to the respective line spectrum data in said frequency allotment means, at a given time point using said pitch position information;

first addition means for adding said sinusoidal wave signals from said frequency control means to each other; and modulation means for modulating the added signals supplied from said first addition means by said amplitude information.

2. A speech processing system according to claim 1, wherein said first addition means further comprising means for continuously connecting each of the sinusoidal wave signals to the other sinusoidal wave signals at said given time points.

3. A speech processing system according to claim 1, further comprising:

line spectrum extraction means for extracting line spectrum data from the modulated signal supplied from said modulation means;

second pitch position extraction means for extracting a time point of the pitch position information by extracting the frequency change of the modulated signal;

second amplitude extraction means for extracting the amplitude data from said modulated signal; and speech synthesis means for synthesizing a speech signal from extracted line spectrum data, said pitch position data and said amplitude data.

4. A speech processing system according to claim 3, wherein said line spectrum extraction means includes window processing means for performing predetermined window processing on said modulated signal, Fourier analysis means for performing Fourier analysis on the window-processed signal and extraction means for extracting approximate line spectrum data from an output supplied from the Fourier analysis means.

5. A speech processing system according to claim 4, further comprising:

variable length window processing means for window-processing said modulated signal by a window signal having a window length determined by said approximate line spectrum data;

line spectrum estimation means for estimating and extracting line spectrum data from the output of said variable length window processing means and changing the window length of said window signal of said variable length window processing means by the extracted line spectrum data;

moving window processing means for window-processing said modulated signal by a sequentially moved window signal having a window length determined by the estimated line spectrum data determined by said line spectrum estimation means; and pitch position estimation means for estimating the pitch position information from the output of said moving window processing means.

6. A speech processing system according to claim 5, wherein said variable length window processing means, said line spectrum estimation means, said moving window processing means and said pitch position estimation means are arranged for each line spectrum data.

7. A speech processing system according to claim 6, further comprising addition means for adding outputs of said pitch position estimation means.

8. A speech processing system according to claim 7, further comprising means for clipping and wave-shaping the output of said addition means and outputting voiced/ unvoiced(V/UV) data in response to a generation of the output from said wave-shaping processing.

9. A speech processing system according to claim 3, further comprising means for sampling said modulated signal by a frequency greater than said first frequency and converting it to a digital signal.

10. A speech processing system according to claim 1, wherein said first pitch position extraction means includes residue generation means for removing a spectrum component from said speech signal and generating a signal in which the spectrum component is removed as a residual signal.

11. A speech processing system according to claim 10, wherein said residue generation means includes means for extracting linear predictive coding (LPC) coefficients from said speech signal and an LPC inverse filter having filter coefficients corresponding to said extracted LPC coefficients and outputting said residue signal.

12. A speech processing system according to claim 10, wherein said first pitch position extraction means further includes;

means for determining pitch prediction coefficients, which are defined as coefficients for optimal pitch prediction of said residual signal at a certain timing by utilizing said residual signal at a plurality of timings;

a plurality of first multiplication means for multiplying each of said pitch prediction coefficients by each of the signals at a plurality of said timings, respectively;

second addition means for adding the outputs of said first multiplication means;

second multiplication means for multiplying the output of said second addition means by said residual signal; and center clipper means for determining a peak position of the output of said second multiplication means and outputting it as pitch position data.

13. A speech processing system according to claim 12, further comprising means for detecting whether said speech signal is a voiced or unvoiced signal and for producing a gate signal when said speech signal is a voiced signal, wherein said center clipper means includes:

comparison means for comparing the output of said second multiplication means and a delayed input and generating a control signal when said output of said second multiplication means is greater than said delayed input;

AND means responsive to said gate signal and to said control signal for generating an output;

unit delay means for delaying an input thereto by a predetermined unit time and supplying the output thereof as said delayed input to said comparison means;

third multiplication means for multiplying the output of said unit delay means by a coefficient smaller than 1; and switch means for switching the output of said second multiplication means and the output of said third multiplication means in response to said control signal and applying the output thereof as the input to said unit delay means.

14. A speech processing system according to claim 1, wherein said first pitch extraction means comprises a decimator for converting said speech signal into a signal sampled by a second frequency smaller than said first frequency, first means for extracting pitch position information out of the output of said decimator, and interpolation means for interpolating the extracted pitch position information from said first means to output a signal as the output of said first pitch extraction means.

15. A speech processing system according to claim 1, further comprising thin-out means for thinning out said extracted pitch position data.

16. A speech processing system according to claim 15, wherein said thin-out means thins out said pitch position data to ½ of its original value.

17. A speech processing system according to claim 15, wherein said thin-out means includes a D-type flip-flop receiving said pitch position data at a clock input and AND means receiving said pitch position data and one of the two outputs of said flip-flop for outputting an output when said pitch position data and said one of said two outputs are received.

18. A speech processing system according to claim 1, wherein said frequency allotment means includes accumulation means for measuring and accumulating a phase shift quantity of said sinusoidal wave signals having the allotted frequencies and sinusoidal wave generation means for generating a sinusoidal wave signal corresponding to the accumulated phase shift quantity.

19. A speech processing system according to claim 18, wherein said sinusoidal wave generation means is a read only memory (ROM) which stores sinusoidal wave data and generates said sinusoidal wave by reading out the stored data therefrom.

20. A speech processing system according to claim 1, wherein said line spectrum data are LSP (Line Spectrum Pairs) data.

21. A speech processing system comprising:

means for extracting spectrum information of a speech signal for each analysis frame of a predetermined time period as a plurality of line spectrum data;

means for extracting a pitch position data of said speech signal for each analysis frame;

means for extracting amplitude data of said speech signal for each analysis frame;

means for changing the phase of an analog signal corresponding to said line spectrum in response to said pitch position data; and means for amplitude modulating said analog signal by said amplitude data to output a modulated signal.

22. A speech processing system according to claim 21, further comprising:

means for extracting the phase change time point of said modulated signal as a pitch position data;

means for extracting said line spectrum data and said amplitude data from said modulated signal; and means for synthesizing a speech signal from said extracted pitch position data, line spectrum data and amplitude data.

23. A speech processing method comprising the steps of:

sampling an input speech at a first frequency and outputting the thus sampled speech as a speech signal in digital form;

extracting the spectrum information of said speech signal for each analysis frame of a predetermined time period as a plurality of line spectrum data;

extracting pitch position data of said speech signal for each analysis frame;

extracting amplitude data of said speech signal for each analysis frame;

generating and allotting sinusoidal wave signals having predetermined frequencies to each of a plurality of said line spectrum data;

changing the frequencies of said sinusoidal wave signals, which are allotted to the respective line spectrum data, at a given time point using said pitch position information;

summing sinusoidal wave signals after said frequency change; and modulating the added signal by said amplitude data.

* * * * *

UNITED STATES PATENT AND TRADEMARK OFFICE

CERTIFICATE OF CORRECTION

PATENT NO. : 4,937,868

DATED : June 26, 1990

INVENTOR(S) : Tetsu TAGUCHI

It is certified that error appears in the above-identified patent and that said Letters Patent is hereby corrected as shown below:

Col. 4, line 9, delete "$X_i$" and insert --$\hat{X}_i$--;

Col. 4, line 11, delete "$X_i$" and insert --$\hat{X}_i$--;

Col. 4, line 17, delete "(= $X_i$ - $X_i$) and insert --(= $X_i$ - $\hat{X}_i$)--;

Col. 6, line 40, delete "$0.9972^2$" and insert --$0.997^2$--;

Col. 6, line 49, delete "1" and insert -- 1 --;

Col. 6, line 64, after "comparator" insert --771--;

Col. 7, line 30, delete "$\beta$" and insert --$\alpha$--;

Signed and Sealed this

Thirty-first Day of December, 1991

*Attest:*

*Attesting Officer*

HARRY F. MANBECK, JR.

*Commissioner of Patents and Trademarks*